US009354546B2

(12) United States Patent
Berg et al.

(10) Patent No.: US 9,354,546 B2
(45) Date of Patent: May 31, 2016

(54) METHOD TO OPERATE A PRINTER GIVEN EXCHANGE OF A RESERVOIR

(71) Applicant: Oce Printing Systems GmbH & Co. KG, Poing (DE)

(72) Inventors: Martin Berg, Poing (DE); Franz Kastner, Munich (DE); Gunnar Raschke, Munich (DE)

(73) Assignee: Oce Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/700,518

(22) Filed: Apr. 30, 2015

(65) Prior Publication Data

US 2015/0316872 A1 Nov. 5, 2015

(30) Foreign Application Priority Data

Apr. 30, 2014 (DE) ..... 10 2014 106 038

(51) Int. Cl.
*G03G 15/08* (2006.01)
*G03G 15/06* (2006.01)

(52) U.S. Cl.
CPC ..... *G03G 15/0825* (2013.01); *G03G 15/065* (2013.01); *G03G 15/0822* (2013.01); *G03G 15/0887* (2013.01)

(58) Field of Classification Search
CPC ..... G03G 15/0825; G03G 15/0887; G03G 15/10; G03G 15/104; G03G 2215/0658
See application file for complete search history.

(56) References Cited

U.S. PATENT DOCUMENTS

| | | | | |
|---|---|---|---|---|
| 5,826,148 | A * | 10/1998 | Iino | G03G 15/101 399/239 |
| 6,018,636 | A | 1/2000 | Caruthers | |
| 6,055,387 | A * | 4/2000 | Koshio | G03G 15/104 399/240 |
| 7,228,080 | B2 | 6/2007 | Hamby et al. | |
| 2007/0053702 | A1 * | 3/2007 | Aratake | G03G 15/0121 399/27 |
| 2014/0212176 | A1 | 7/2014 | Berg | |

FOREIGN PATENT DOCUMENTS

| | | | |
|---|---|---|---|
| DE | 102009005371 | A1 | 7/2010 |
| DE | 102013100843 | B3 | 2/2014 |

* cited by examiner

*Primary Examiner* — Sandra Brase
(74) *Attorney, Agent, or Firm* — Schiff Hardin LLP

(57) ABSTRACT

In a method to operate a printer or copier to print to a printing substrate, or in such a printer or copier, toner concentrate is extracted from a toner concentrate reservoir and carrier fluid is extracted from a carrier fluid reservoir. The extracted toner concentrate and carrier fluid are supplied to a mixer where mixing occurs to form a developer mixture. The developer mixture is applied to a developer roller with aid of an electrical field. Given an exchange of least one of the toner concentration reservoir and the carrier fluid reservoir, a strength of the electrical field is modified such that a predetermined desired inking of the printing substrate is maintained even given a change of a toner concentration in the developer mixture due to the exchange.

15 Claims, 3 Drawing Sheets

METHOD TO OPERATE A PRINTER GIVEN EXCHANGE OF A RESERVOIR

BACKGROUND

The disclosure concerns a method to operate a printer or copier to print to a printing substrate, in which method toner concentrate is extracted from a toner concentrate reservoir, carrier fluid is extracted from a carrier fluid reservoir, and these are supplied to a mixer. In the mixer, the toner concentrate and carrier fluid are mixed to form a developer mixture which is subsequently applied to a developer roller in a developer station. The disclosure also concerns a corresponding printer.

In printers that operate according to the electrophoretic principle, the fluid developer mixture made of a toner concentrate and a carrier fluid is mixed together in a mixer. The developer mixture that is obtained in such a manner—which developer mixture is also designated as liquid developer—is applied to a developer roller in a developer station. Depending on the image to be printed, the developer mixture is transferred from the developer roller onto a photoconductor drum and is further transferred from this to a transfer roller. The toner is finally transferred electrophoretically from the transfer roller to the printing substrate.

The toner concentrate and the carrier fluid are supplied from corresponding reservoirs to the mixer as needed. The reservoirs must be regularly exchanged accordingly if they are completely or nearly completely empty. During this exchange, toner concentrate or carrier fluid may no longer be supplied to the mixer from the corresponding reservoir, such that a maintenance of the composition of the developer mixture (and thus a maintenance of the toner concentration) is not possible without further measures.

Therefore, intermediate stores or buffers are provided in which a predetermined quantity of toner concentrate and carrier fluid can be cached and which then is supplied to the mixer upon exchange of the corresponding reservoir. It is thus achieved that the same amount of toner concentrate or carrier fluid can be supplied as in regular operation, even upon exchange of the reservoir, such that the toner concentrate in the developer mixture remains the same.

It is a disadvantage of this method that extra modules must be provided for such intermediate storage, and thus additional scarce structural space is also required. Moreover, cost-intensive dosing valves must be provided at the intermediate stores. An additional disadvantage is that sediments often settle in intermediate containers, which can negatively affect the functionality of the printer.

From the document U.S. Pat. No. 6,229,775 B1, a printer is known in which hatches are provided via which the reservoirs can be refilled. It is hereby achieved that the reservoirs do not need to be exchanged at all.

In the document US 2013/0272733 A1, an additional printer is described in which multiple developer stations are supplied with developer mixture from an intermediate container. Depending on the printing mode, different numbers of developer stations are participating in the printing, and the fill level of the developer mixture in the mixer is preset differently depending on the operating mode.

SUMMARY

It is an object to specify a method to operate a printer or copier and a printer with whose help a continuous printing operation without interruptions is possible in a simple manner.

In a method to operate a printer or copier to print to a printing substrate, or in such a printer or copier, toner concentrate is extracted from a toner concentrate reservoir and carrier fluid is extracted from a carrier fluid reservoir. The extracted toner concentrate and carrier fluid are supplied to a mixer where mixing occurs to form a developer mixture. The developer mixture is applied to a developer roller with aid of an electrical field. Given an exchange of least one of the toner concentration reservoir and the carrier fluid reservoir, a strength of the electrical field is modified such that a predetermined desired inking of the printing substrate is maintained even given a change of a toner concentration in the developer mixture due to the exchange.

DESCRIPTION OF EXEMPLARY EMBODIMENTS

Figure 1:
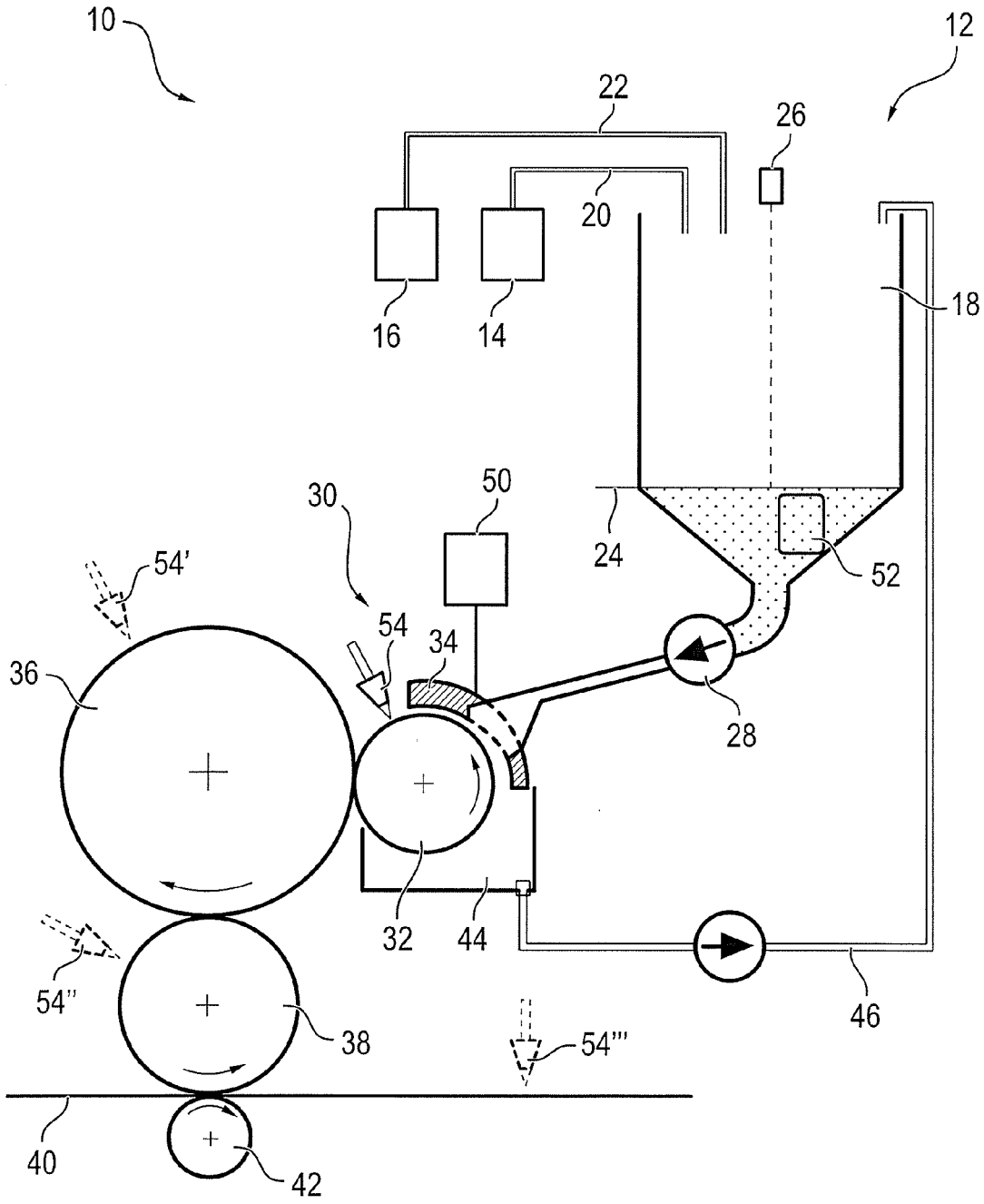
FIG. 1 is a presentation of a printing system in a first operating state.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

According to an exemplary embodiment, given an exchange of the toner concentrate reservoir and/or of the carrier fluid reservoir the electric voltage potential of the electric field is altered such that a predetermined desired inking of the printing substrate is maintained, even given a change of the toner concentrate in the developer mixture that is due to the exchange of the toner concentrate reservoir or carrier fluid reservoir.

It is hereby achieved that it is not necessary to maintain the toner concentrate in the developer mixture at all times. The desired inking can be achieved given different toner concentrations since the field strength of the electric field is varied. In particular, it is thus not necessary to provide intermediate storage and additional components via which an intermediate storage of toner concentrate and carrier fluid is possible. A more compact structural design is thus possible since no space is required for intermediate storage. Moreover, the risk of sedimentation within the intermediate storage is avoided.

What is understood in particular by the desired inking is with what layer thickness the toners are too applied in the printed region of the printing substrate.

The developer mixture is preferably applied onto the developer roller with the aid of an electrode segment. The electrode segment in particular forms a first electrode and the developer roller forms a second electrode, between which a voltage potential exists so that the electric field is generated.

The developer mixture is in particular applied from the mixer onto the developer roller. Via the electric field, the developer mixture layer applied onto the developer roller is subdivided into two sub-layers, namely a toner particle-rich layer in the region of the surface of the developer roller and a toner particle-poor layer in the region of the developer layer that is facing away from the surface of the developer roller. The stronger the electric field, the more particles of the developer mixture that are moved in the direction of the developer roller. Given a lower concentration of the toner particles in the developer mixture, via a correspondingly higher field strength of the electric field it can thus be achieved that approximately the same number of toner particles accumulates per area unit in the toner particle-rich layer as for the case in which the toner particle concentration in the developer mixture is higher and a lower electrode segment voltage is set. Thinning or increased concentration of the developer mixture can thus be compensated via the adaptation of the voltage potential of the electric field, such that the same desired inking can nevertheless be achieved for different toner concentrations in the developer mixture.

In a preferred embodiment, given an increase of the toner concentration in the developer mixture the voltage potential of the electric field is reduced. With this it is achieved that the field strength of the electric field of the electrode segment is likewise reduced, such that the forces acting on the charged toner particles in the developer mixture are lower, and thus fewer toner particles are moved in the direction of the developer roller.

Conversely, given a reduction of the toner concentration in the developer mixture the voltage potential can be increased, such that accordingly the field strength is increased and the forces acting on the toner particles are increased.

Given an exchange of the toner concentrate reservoir, in particular a thinning of the developer mixture takes place, meaning that the toner concentration in the developer mixture becomes reduced since new toner concentrate (which has a higher toner concentration than the desired toner concentration of a developer mixture) is no longer supplied. However, at the beginning of the exchange of the toner concentrate reservoir an increased concentration in the developer mixture can also occur since, just before the complete emptying of the toner concentrate reservoir, the remainder still located in the toner concentrate reservoir is already pumped into the mixer, and thus more toner concentrate is supplied at this point in time than is typical.

Given an exchange of both the toner concentrate reservoir and the carrier fluid reservoir, a continuous change of the toner concentration thus takes place within the developer mixture. The continuous change is always compensated via a corresponding continuous change of the strength of the electric field, such that a consistent inking—and thus a consistent print quality—is achieved.

The voltage of the electrode segment is thus modified in particular such that approximately the same predetermined number of toner particles are applied, independent of the toner concentration per area unit of the developer roller.

It is particularly advantageous if the real toner concentration in the developer mixture is measured with the aid of a concentration sensor. This real concentration is in particular compared with a desired concentration, wherein the strength of the electrical field is then set depending on the result of the comparison.

Alternatively, instead of the comparison with the desired toner concentration, the real concentration is also directly compared with an assignment rule in which the respective voltage potential of the electrical field that is necessary in order to achieve the desired inking at a given real toner concentration is respectively provided and uniquely assigned for a multitude of possible toner concentrations. The assignment rule can in particular have been determined experimentally and/or by calculation beforehand, and can be stored in a control unit of the printer. In an alternative method, the necessary voltage potential can also be calculated in real time.

Alternatively, instead of a concentration sensor, an inking sensor can also be provided with the aid of which a real inking can be determined, which is output as an inking signal. The voltage potential is then set depending on this inking signal. For example, an assignment rule (which can also be designated as a lookup table) can hereby be used. Alternatively, a comparison with the desired inking can also take place, and a control and/or regulation can be implemented from this comparison.

The inking sensor is in particular designed as a reflection sensor that determines the reflection of the inked surface in its detection region.

The inking is determined with the aid of the inking sensor, in particular in the region of the developer roller, a photoconductor, a transfer carrier (a transfer roller, for example) and/or directly in the region of the printing substrate.

In a particularly preferred embodiment, both an inking sensor and a concentration sensor can also be provided, wherein one of these two sensors then serves for the actual regulation of the strength of the electrical field and the other sensor serves for monitoring the regulation. A particularly certain process is thus achieved.

It is particularly advantageous if the desired concentration is preset such that a sufficient deviation of the real concentration from the desired concentration is possible both upward and downward, and can be compensated via a corresponding change of the strength of the electrical field.

A desired concentration of 10% is preferably preset, wherein given a deviation of ±5% a compensation can take place via a corresponding modification of the strength of the electrical field so that the desired inking is maintained. In the extreme case, it is even possible to guarantee the desired inking via the change of the field strength given a real toner concentration between 3% and 30%. In particular, it is thus possible that the printing operation can be continued for up to 30 minutes even if no toner concentrate reservoir or carrier fluid reservoir is present. There is thus sufficient time to exchange the reservoirs.

If the real concentration reaches the limit of the working range (thus the limit of that range within which a concentration change can be compensated via the modification of the voltage potential), the feed of the still-connected consumable substance is in particular stopped so that the real concentration does not leave the working range.

An additional aspect of the exemplary embodiment concerns a printer to print to a printing substrate, which printer has a mixer to mix toner concentrate (extracted from a toner concentrate reservoir) and carrier fluid (extracted from a fluid reservoir) into a developer mixture. The printer also has a developer station that comprises an application unit and a developer roller, wherein the developer mixture is applied onto the developer roller with the aid of an electrical field generated via the application unit. Furthermore, the printer has a control unit that, given an exchange of the toner concentration reservoir or of the carrier fluid reservoir, modifies the strength of the electrical field such that a predetermined desired inking of the printing substrate is maintained, even given a change of the toner concentration in the developer mixture due to the exchange of the toner concentrate reservoir and/or of the carrier fluid reservoir.

Additional features and advantages result from the following description, which explains the exemplary embodiments together with accompanying schematic drawing figures.

A schematic presentation of a printing system 10 in a first operating state is shown in FIG. 1. The printing system 10 comprises a schematically depicted print group 12 as well as a toner concentration reservoir 14 and a carrier fluid reservoir 16. A toner concentrate is stored in the toner concentrate reservoir 14, and corresponding carrier fluid is stored in the carrier fluid reservoir 16. The reservoirs 14, 16 are in particular designed in the form of exchangeable drums.

The first operating state is in particular that state in which the print group 12 is operated during normal operation, i.e. that state in which both a toner concentrate reservoir 14 and a carrier fluid reservoir 16 are connected and both are not empty.

The print group 12 comprises a mixer 18 in which toner concentrate is conveyed from the toner concentrate reservoir 14 and carrier fluid is conveyed from the carrier fluid reservoir 16 via conduits 20, 22. With the aid of the mixer 18, the toner concentrate and the carrier fluid are mixed into a developer mixture, which is often also designated as liquid developer. In FIG. 1, the current fill level of the mixer 18 is indicated via the line 24, which fill level changes during printing operation, or which mixer 18 always has the same toner concentration in the first operating mode in that corresponding quantities of toner concentrate and carrier fluid are supplied again from the reservoirs 14, 16 to the mixer 18 given extraction of developer mixture from the mixer 18. The fill level is in particular determined via a fill level sensor 26.

The developer mixture is supplied with the aid of a pump 28 to a developer station 30 that comprises a developer roller 32 and an electrode segment 34. Via a voltage of the electrode segment 34, an electrical field is developed between the electrode segment 34 and the developer roller 32, via which the developer mixture layer that is applied onto the developer roller 32 is subdivided into a toner particle-poor layer and a toner particle-rich layer, wherein the toner particle-rich layer is arranged near to the developer roller 32 and the toner particle-poor layer is arranged near to the electrode segment 34.

Via the rotation of the developer roller 32, the developer mixture layer is subsequently directed past a dosing roller (not shown). Via this dosing roller, the outer sub-layer of the developer mixture layer (i.e. the toner particle-poor sub-layer) is removed from the developer roller 32 so that only a developer mixture layer with a predetermined layer thickness still remains after the dosing roller is directed past the developer roller 32. The layer thickness is approximately 2 to 8 μm.

In an alternative embodiment, the electrode segment 34 can also apply the liquid developer to the developer roller via the dosing roller.

Toner is subsequently electrophoretically transferred onto a photoconductor 36 in the image regions of the image to be printed, and further onto a transfer roller 38. The actual print image is then transferred via the transfer roller 38 onto the printing substrate 40, which moves a nip or transfer gap formed between the transfer roller 38 and a counter-pressure roller 42.

The developer mixture removed from the developer roller 32 by the dosing roller is captured via a capture container 44 and is transported back into the mixer 18 via a return conduit 46. In an alternative embodiment, the developer mixture captured in the capture container 44 can also not be transported back into the mixer 18 but rather can be disposed of in a waste container.

In an alternative printing system, in particular multiple such print groups 12 can also be provided, wherein a print group 12 is provided in particular for each color. In particular, four to seven print groups 12 are thus provided given single-sided printing; correspondingly, in particular eight to fourteen print groups 12 are provided given double-sided printing.

Upon exchanging the toner concentrate reservoir 14, a thinning of the developer mixture occurs in the mixer 18 since carrier fluid is supplied as before but no additional toner concentrate is supplied to the mixer 18. However, at the beginning of the exchange of the toner concentrate reservoir a short-term increased concentration of the developer mixture 18 can also initially occur since at first a remainder still located in the toner concentrate container 14 is pumped all at once into the mixer 18, and thus for a short period more toner concentrate is supplied than is typical.

Accordingly, given an exchange of the carrier fluid reservoir 16 an increased concentration of the developer mixture occurs in the mixer 18 since unmodified toner concentrate supplied by additional carrier fluid is no longer supplied. Conversely, however, a short-term thinning of the developer mixture in the mixer 18 can also occur at the beginning of the exchange of the carrier fluid reservoir 16 since at first a remainder of carrier fluid is supplied that excessively thins the toner concentrate.

Figure 2:
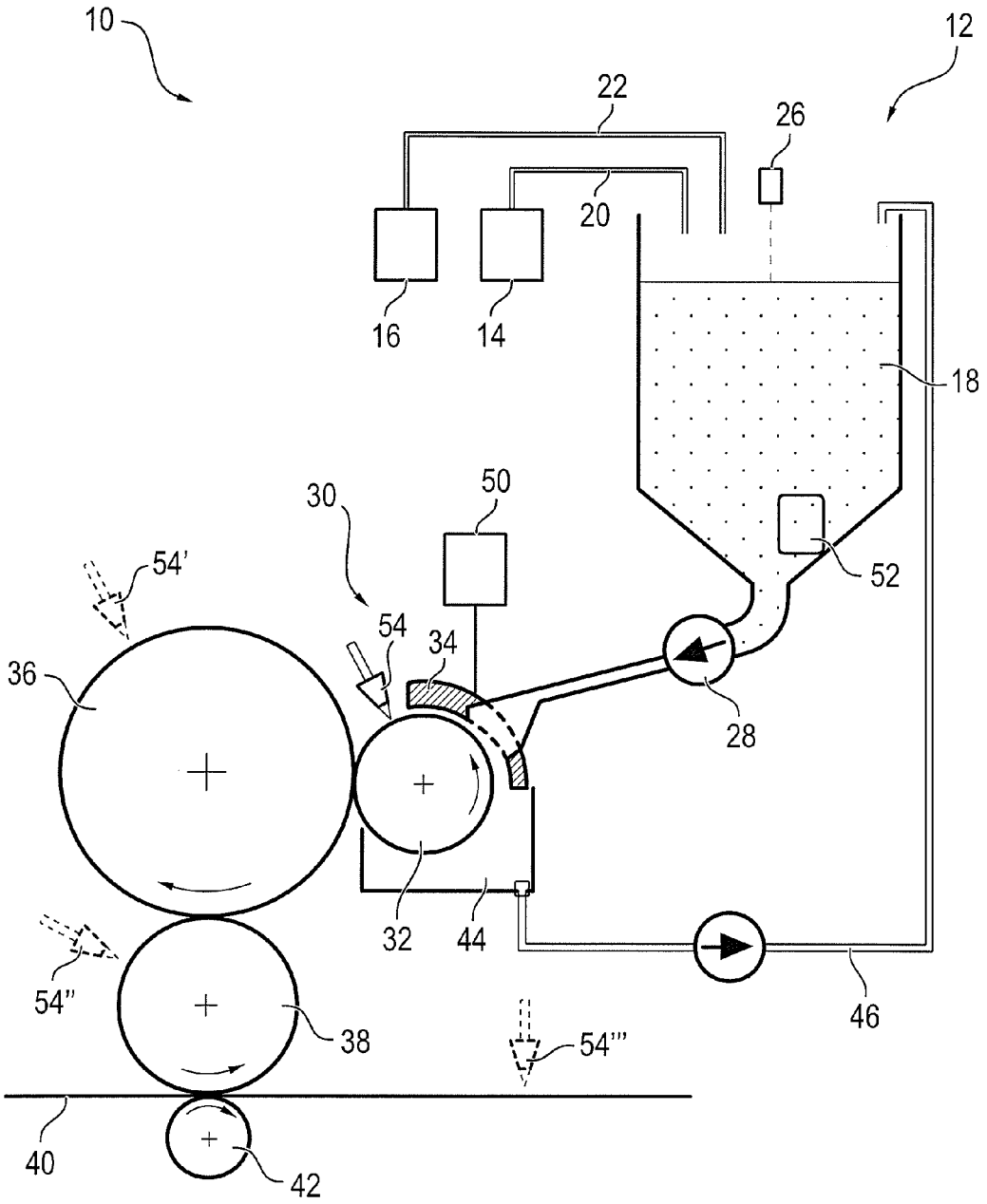
FIG. 2 is a presentation of the printing system according to FIG. 1 in a second operating state.
Figure 3:
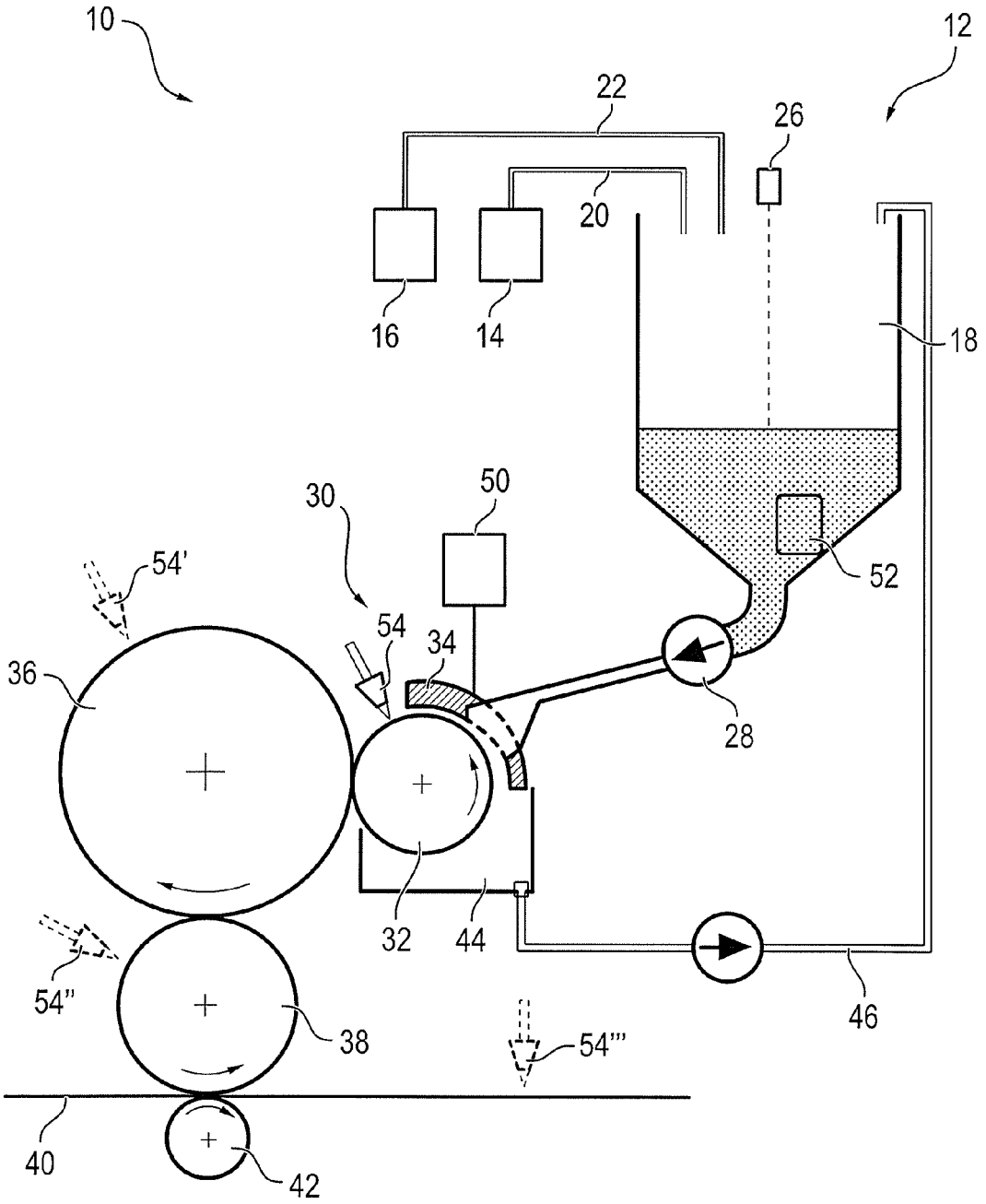
FIG. 3 is a presentation of the printing system according to FIGS. 1 and 2 in a third operating state.

What is understood by a thinning is in particular that the toner concentration within the developer mixture 18 is reduced. What is accordingly understood by an increased concentration is that the toner concentration in the developer mixture becomes greater. Such a thinning of the developer mixture is shown in FIG. 2, and a corresponding increased concentration of the developer mixture is shown in FIG. 3.

In order to achieve a consistent desired inking of the printing substrate 42—meaning that the printing substrate 40 has a desired layer thickness of toner in the printed regions—the same layer thickness must always be applied to these printed regions. For this, it is accordingly also necessary that the same number of toner particles is applied per area unit to the developer roller 32.

In order to achieve this even given a thinning or increased concentration of the developer mixture, the voltage of the electrode segment 34 is varied via a control unit 50 so that the electrical field strength of the electrical field between the electrode segment 34 and the developer roller 32 is modified accordingly. Given a thinning of the developer mixture, the voltage of the electrode segment 34 is increased so that the forces acting on the charged toner particles become greater, and more toner particles are moved near to the developer roller 32. It is hereby compensated that fewer toner particles are located in the developer mixture.

Accordingly, given an increased concentration of the developer mixture the voltage of the electrode segment 34 is reduced so that the field strength of the electrical field also decreases and weaker forces act on the charged toner particles. Proportionately fewer toner particles are thus moved to the developer roller 32, such that the greater (in absolute terms) proportion of toner particles in the developer mixture is compensated.

In particular, the adjustment of the voltage of the electrode segment 34 takes place such that, at least within a predetermined toner concentration range, the same desired inking of the print image 34 is always achieved independently of what concentration of the toner particles the developer mixture has.

In particular, for this a concentration sensor 52 is provided in the mixer 18, via which the real concentration of toner particles in the developer mixture is determined. In particular, via an assignment rule for each determined real value the necessary voltage for the electrode segment 34 is determined and set accordingly via the control unit 50. The association rule is in particular stored within the control unit 50 and can have been created experimentally and/or computationally.

Additionally, an inking sensor 54 is providing with the aid of which the real inking in the region of the developer roller 32 is determined after the electrode segment 34. In particular, a monitoring of the regulation of the voltage of the electrode segment 34 that is achieved via the concentration sensor 52 can take place via the inking signal of the inking sensor 54.

In an alternative embodiment, the inking sensor 54 can also determine the inking of the photoconductor 36, the transfer roller 38 and/or the printing substrate 40. The corresponding sensors are depicted with dashed lines in FIG. 1 and designated with the reference characters 54', 54" or 54'".

In an additional alternative embodiment, only a concentration sensor 52 and no inking sensor 54 can also be provided.

It is likewise alternatively possible that no concentration sensor 52 and only an inking sensor 54 is provided. In this case, the control or regulation of the voltage of the electrode segment takes place depending on the signal of the inking sensor 54. This can also in particular take place again via an association rule, in particular in the form of a lookup table.

The mixer 18 is in particular dimensioned to be sufficiently large so that an interruption-free printing can be ensured solely from the developer mixture located in the mixer 18 during the exchange of one of the reservoirs 14, 16. The desired toner concentration—i.e. that toner concentration in the first operating state, thus if both reservoirs 14, 16 are connected and not empty—is in particular selected such that sufficient margin is provided for the increase and decrease of the toner concentration during an exchange of the reservoirs 14, 16. The desired concentration of the developer mixture in particular has a value of 10%, wherein the variation range within which the toner concentration can fluctuate and can be compensated via the variation of the voltage of the electrode segment is between 3% and 30%, and preferably between 5% and 15%.

In particular, the mixer 18 is dimensioned such that the printing operation can be continued from it for at least approximately 30 minutes via the corresponding adaptation of the voltage, even if one of the two reservoirs 14, 16 is not presently connected.

Via the printing system described in the preceding it is achieved that no intermediate storage must be provided for intermediate storage of toner concentrate and carrier fluid; rather, given an exchange of one of the reservoirs 14, 16 the printing operation can be maintained purely from the reserve within the mixer 18 by modifying the voltage of the electrode segment.

The number of necessary components is hereby reduced, such that costs and structural space can be saved. Problems with sedimentation in intermediate stores are also avoided.

In an alternative embodiment, an intermediate storage can also be provided for the toner concentration or the carrier fluid, and the compensation of the concentration change via the voltage adaptation can also be implemented only upon exchanging the reservoir 14, 16 of the other component.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to operate a printer or copier to print to a printing substrate, comprising the steps of:

providing an inking sensor for measuring an inking of at least one of a developer element in a developer station and an image carrier element;

mixing toner concentrate and carrier fluid in a mixer having a toner concentration sensor to form a developer;

at a point in time during the printing to the printing substrate removing and exchanging only one of a toner concentrate reservoir or a carrier fluid reservoir such that until the removal and exchange is completed only one of the reservoirs is available to supply only one of the toner concentrate or the carrier fluid respectively to the mixer resulting in a change of toner concentration in the developer;

applying the developer from the mixer to ink said developer element in said developer station with aid of an electrical field;

by use of the inked developer element inking an image carrier element; and given said removal and exchange of only one of the toner concentrate reservoir or the carrier fluid reservoir at said point in time during the printing, by use of at least one of a toner concentration measurement by said toner concentration sensor and an inking measurement by said inking sensor modifying a strength of the electrical field of the developer station such that a predetermined desired inking of the printing substrate is maintained even given said supply of only one of said toner concentrate or the carrier fluid to said mixer during the printing which causes said change of the toner concentration of the developer in said mixer during the printing.

2. The method according to claim 1 wherein the developer element inks the printing substrate by use of a photoconductor and a transfer element.

3. The method according to claim 1 wherein a voltage potential of the electrical field is reduced given an increase of the toner concentration of the developer in said mixer.

4. The method according to claim 1 wherein a voltage potential of the electrical field is increased given a reduction of the toner concentration of the developer in said mixer.

5. The method according to claim 1 wherein the strength of the electrical field of the developer station is adapted to the toner concentration of the developer in said mixer such that a toner layer applied to the developer element has a same predetermined thickness, independent of the toner concentration.

6. The method according to claim 1 wherein the toner concentration in said mixer is compared with a predetermined desired toner concentration; and a voltage potential of the electrical field is adjusted depending on a result of the comparison.

7. The method according to claim 1 wherein the electrical field is generated with the aid of an electrode segment.

8. The method according to claim 1 wherein the developer element comprises a developer roller, and the inking sensor measures the inking of the printing substrate by detecting an inking of at least one of said developer roller, a photoconductor, a transfer element, and the printing substrate.

9. The method according to claim 1 wherein a desired toner concentration that the developer in the mixer has while supply from the toner concentrate reservoir or the carrier fluid reservoir is taking place is set, such that a deviation of the toner concentration from the desired toner concentration within a predetermined range is compensated via a modification of a voltage of the electrode segment.

10. The method according to claim 1 wherein both said toner concentration measurement and said inking measurement are used for modifying said strength of the electrical field of the developer station during the printing.

11. The method according to claim 1 wherein the image carrier element comprises at least one of a photoconductor, a transfer element, and said printing substrate.

12. A printer or copier which prints to a printing substrate, comprising:

a mixer having a toner concentration sensor and which mixes toner concentrate and carrier fluid to form a developer;

a toner concentrate reservoir which supplies toner concentrate to said mixer and a carrier fluid reservoir which supplies carrier fluid to said mixer, and wherein only one of said toner concentrate reservoir or said carrier fluid reservoir supply only one of said respective toner concentrate or said carrier fluid to the mixer at a point in time during printing to the printing substrate when a removal and exchange of only one of the toner concentrate reservoir or said carrier fluid reservoir occurs;

a developer element in a developer station to which is supplied developer from said mixer with aid of an electrical field to ink the developer element;

an inking station at which the printing substrate is inked;

an inking sensor which measures an inking of at least one of said developer element and an image carrier element; and a controller, given said supplying of only one of the toner concentrate or the carrier fluid to said mixer at said point in time during the printing when said removal and exchange occurs, using at least one of a toner concentration measurement by said toner concentration sensor and an inking measurement by said inking sensor modifying a strength of the electrical field of the developer station such that a predetermined desired inking of the printing substrate is maintained even given said supply of only one of said toner concentrate or the carrier fluid to said mixer during the printing which causes a change of a toner concentration of the developer in said mixer during the printing based on said removal and exchange.

13. The printer or copier of claim 12 wherein the controller uses both the toner concentration measurement and the inking measurement for modifying said strength of the electrical field during the printing.

14. The printer or copier of claim 12 wherein the developer element inks the printing substrate by use of a photoconductor and a transfer element.

15. The printer or copier of claim 12 wherein the image carrier element comprises at least one of a photoconductor, a transfer element, and said printing substrate.

* * * * *